US009657439B2

(12) United States Patent
Lauer

(10) Patent No.: US 9,657,439 B2
(45) Date of Patent: May 23, 2017

(54) METHOD FOR PRODUCING A STRAND OR CABLE

(75) Inventor: Bruno Lauer, Marpingen (DE)

(73) Assignee: CASAR DRAHTSEILWERK SAAR GMBH, Kirkel (DE)

( * ) Notice: Subject to any disclaimer, the term of this patent is extended or adjusted under 35 U.S.C. 154(b) by 550 days.

(21) Appl. No.: 13/984,597

(22) PCT Filed: Feb. 13, 2012

(86) PCT No.: PCT/DE2012/200008
§ 371 (c)(1),
(2), (4) Date: Oct. 21, 2013

(87) PCT Pub. No.: WO2012/107042
PCT Pub. Date: Aug. 16, 2012

(65) Prior Publication Data

US 2014/0069074 A1 Mar. 13, 2014

(30) Foreign Application Priority Data

Feb. 12, 2011 (DE) ..... 10 2011 011 112

(51) Int. Cl.
*D07B 1/16* (2006.01)
*D07B 5/12* (2006.01)
(Continued)

(52) U.S. Cl.
CPC ..... *D07B 1/16* (2013.01); *D07B 1/165* (2013.01); *D07B 5/00* (2013.01); *D07B 5/12* (2013.01);
(Continued)

(58) Field of Classification Search
CPC . D07B 1/16; D07B 1/165; D07B 5/00; D07B 5/12; D07B 7/145
See application file for complete search history.

(56) References Cited

U.S. PATENT DOCUMENTS 1,993,110 A * 3/1935 Myers, Jr. ..... D07B 7/12 57/138
2,055,750 A 9/1936 Reber
(Continued)

FOREIGN PATENT DOCUMENTS

DE 1510077 6/1969
DE 3045941 7/1982
(Continued)

OTHER PUBLICATIONS

"Auf Die Seele Kommt Es An" (Feb. 1, 1993), pp. 8-10.

*Primary Examiner* — Shaun R Hurley
(74) *Attorney, Agent, or Firm* — Lucas & Mercanti, LLP; Klaus P. Stoffel

(57) ABSTRACT

A method for producing a strand or cable, in which fibers and/or wires are twisted at a twisting point to form the strand or cable. The fibers and/or wires are coated with a liquefied matrix material before and/or at the twisting point and are embedded in the matrix material during twisting. The fibers and/or wires are immersed in the matrix material before and/or at the twisting point and the formed strand or the formed cable is cooled after the twisting in order for the matrix material to solidify, preferably by air or in a cooling liquid, for example water.

22 Claims, 6 Drawing Sheets

(51) Int. Cl.

| | |
|---|---|
| ***D07B 7/14*** | (2006.01) |
| *D07B 1/00* | (2006.01) |
| *D07B 1/02* | (2006.01) |
| *D07B 1/06* | (2006.01) |
| *D07B 1/14* | (2006.01) |
| *D07B 5/00* | (2006.01) |

(52) U.S. Cl.

CPC ..... *D07B 7/145* (2013.01); *D07B 1/005* (2013.01); *D07B 1/025* (2013.01); *D07B 1/0686* (2013.01); *D07B 1/142* (2013.01); *D07B 5/007* (2013.01); *D07B 2201/209* (2013.01); *D07B 2201/2012* (2013.01); *D07B 2201/2044* (2013.01); *D07B 2201/2046* (2013.01); *D07B 2201/2057* (2013.01); *D07B 2201/2073* (2013.01); *D07B 2201/2074* (2013.01); *D07B 2201/2081* (2013.01); *D07B 2201/2087* (2013.01); *D07B 2205/10* (2013.01); *D07B 2205/201* (2013.01); *D07B 2205/205* (2013.01); *D07B 2205/3003* (2013.01); *D07B 2205/3007* (2013.01); *D07B 2205/3021* (2013.01); *D07B 2207/4027* (2013.01); *D07B 2401/201* (2013.01); *D07B 2401/205* (2013.01)

(56) References Cited

U.S. PATENT DOCUMENTS

| | | | | | |
|---|---|---|---|---|---|
| 3,371,476 | A * | 3/1968 | Costello | B62D 55/253 | 28/166 |
| 3,889,455 | A * | 6/1975 | Portinari | H01B 13/328 | 156/48 |
| 3,972,304 | A * | 8/1976 | Boucher | D07B 7/145 | 118/405 |
| 4,017,579 | A * | 4/1977 | Roe | B29C 47/027 | 174/103 |
| 4,034,547 | A * | 7/1977 | Loos | D07B 1/0693 | 57/211 |
| 4,050,230 | A * | 9/1977 | Senoo | D07B 1/025 | 57/231 |
| 4,202,164 | A * | 5/1980 | Simpson | D07B 1/025 | 57/231 |
| 4,269,024 | A * | 5/1981 | Ashpole | G02B 6/449 | 264/1.28 |
| 4,366,667 | A * | 1/1983 | Oestreich | G02B 6/449 | 264/1.28 |
| 4,419,157 | A * | 12/1983 | Ferrentino | H01B 13/321 | 118/44 |
| 4,624,097 | A * | 11/1986 | Wilcox | D07B 1/025 | 57/231 |
| 4,870,814 | A * | 10/1989 | Chacko | D07B 1/148 | 57/217 |
| 4,887,422 | A | 12/1989 | Klees et al. | | |
| 5,601,775 | A * | 2/1997 | Cunningham | D01D 11/06 | 264/103 |
| 6,563,054 | B1 | 5/2003 | Damien et al. | | |
| 6,631,609 | B2 | 10/2003 | Scheunemann | | |
| 8,176,718 | B2 | 5/2012 | Ridge et al. | | |
| 8,468,689 | B2 * | 6/2013 | Spruell | H01B 13/0228 | 29/825 |
| 8,991,146 | B2 * | 3/2015 | Miura | D02G 3/404 | 57/296 |
| 2002/0053386 | A1 | 5/2002 | Hirachi et al. | | |
| 2002/0160213 | A1 | 10/2002 | Imamiya et al. | | |
| 2004/0006963 | A1 * | 1/2004 | Misrachi | D07B 1/144 | 57/223 |
| 2004/0016503 | A1 * | 1/2004 | Stowe | B29C 47/0016 | 156/244.12 |
| 2008/0081721 | A1 | 4/2008 | Bissig et al. | | |
| 2009/0282801 | A1 * | 11/2009 | Gilmore | D07B 1/14 | 57/237 |
| 2011/0284259 | A1 * | 11/2011 | Odot | H01B 7/0275 | 174/113 R |

FOREIGN PATENT DOCUMENTS

| | | | |
|---|---|---|---|
| DE | 3813338 | | 11/1989 |
| EP | 1103653 | | 5/2001 |
| EP | 1186699 | A2 | 3/2002 |
| EP | 1022377 | | 1/2010 |
| FR | 2553442 | | 4/1985 |
| GB | 1391355 | A | 4/1975 |
| GB | 1458086 | | 12/1976 |
| JP | 2242989 | | 9/1990 |
| JP | 0333285 | | 2/1991 |
| WO | 0220898 | | 3/2002 |
| WO | 2004020732 | A2 | 3/2004 |
| WO | 2004029343 | Y | 4/2004 |
| WO | 2008093651 | | 8/2008 |
| WO | 2008141623 | Y | 11/2008 |

* cited by examiner (a) (b)

METHOD FOR PRODUCING A STRAND OR CABLE

The present application is a 371 of International application PCT/DE2012/200008, filed Feb. 13, 2012, which claims priority of DE 10 2011 011 112.3, filed Feb. 12, 2011, the priority of these applications is hereby claimed and these applications are incorporated herein by reference.

BACKGROUND OF THE INVENTION

The invention pertains to a method for producing a strand or cable, in which fibers and/or wires are twisted at a cabling point to form the strand or cable. The invention also pertains to a device for carrying out the method and to a cable which can be produced by the method.

Such methods by means of which wire strands or cables are produced from natural fibers, plastic fibers, or wires are known from a history of use and are usually carried out with a cabling machine. Spools onto which the fiber strands or wires to be cabled are wound are arranged on the rotor of the cabling machine. The fiber strands or wires are guided under rotation to the cabling point, where they are twisted to form the strand or cable, and the formed strand or cable is then wound up onto a cable drum.

Such methods are also used in particular to produce strands and cables which comprise high-strength plastic fibers of aramid, for example. Such strands and cables are very strong for their weight and volume.

For this reason, plastic fiber cables are used in mountain climbing to ensure the safety of the climbers. The advantage of such plastic fibers is also manifest when they are used in wire cables of considerable length for use in suspended applications, e.g., for hoist cables in mining or for deep-sea cables. In applications such as this, the weight of the wire cable itself uses up a large percentage of the load-bearing capacity of the cable; the useful load is reduced to a corresponding extent.

The problem with plastic fibers is that, although they are very strong in the longitudinal direction, they are quite weak in the transverse direction, and there is therefore a considerable danger of breakage under certain types of load.

The plastic fiber cables used to ensure the safety of mountain climbers normally comprise a core-jacket structure, in which the core consists of fiber strands which have been twisted together. The cabled fiber strands are protected from damage by a jacket, which is braided around them and which thus holds them together.

The method indicated above is also used to produce composite cables in which the core cable consists of high-strength plastic fibers and the external strands consist of steel wire. For example, in the case of the cable known from U.S. Pat. No. 6,563,054 B1, a jacket of thermoplastic material is applied around a core cable of parallel plastic fibers, and the steel wire strands are cabled on top of that.

SUMMARY OF THE INVENTION

The invention is based on the goal of creating a method of the type indicated above by means of which strands or cables can be produced which offer mechanical properties superior to those of the known strands or cables.

According to the invention, the goal is achieved in that the fibers and/or the wires are coated with a liquefied matrix material before and/or at the cabling point and are embedded in the matrix material as they are being cabled.

By means of the method, a strand or cable can be produced in which the fibers or, insofar as the fibers are in the form of monofilament bundles, the monofilament bundles or wires in the strand or cable are surrounded by the matrix material, and in which the spaces between the fibers, monofilament bundles, or wires twisted to form the strand or cable are filled by the matrix material. The properties of the strands or cables are especially advantageous when at least the sections of the strand or cable in which the fibers, monofilament bundles, or wires are not at the surface of the strand or cable are completely surrounded by the matrix material. An especially homogeneous strand or an especially homogeneous cable can be produced in this way. The strand or cable, furthermore, can be jacketed with the matrix material at the same time.

The matrix material protects the fibers or wires, bonds them to each other, and transmits the prevailing forces to them. A composite cable with improved mechanical properties is obtained.

Through the choice of the matrix material, furthermore, the mechanical properties of the strand or cable can also be advantageously influenced. Thus the strength will be greater when a high-strength matrix material is chosen then when a less-strong matrix material is selected.

It is also possible, as the fibers or wires are being twisted into a cable, to embed them in the matrix material in the positions which they are intended to assume in the strand or cable. There will then be no need for any further treatment of the cable for the purpose of bringing the fibers or wires into the intended positions.

If the strand is produced by the cabling of preferably twisted monofilament bundles of individual fibers, each of the monofilament bundles is coated with the matrix material and embedded in the matrix material during the cabling process itself, wherein each monofilament bundle remains surrounded by the matrix material. Depending on, for example, the viscosity of the matrix material and on the ability of the matrix material to wet the fiber material, the method also makes it possible for at least individual fibers of the monofilament bundle lying on the outside of the monofilament bundle to be surrounded by the matrix material.

It is advantageous for the monofilament bundles and possibly the individual fibers to be separated from each other by the matrix material, so that the load which they exert on each other in the direction perpendicular to the longitudinal direction is reduced. The danger of breakage is thus significantly decreased. The strands or cables are more resistant than the known strands or cables and have a longer service life.

Whereas the use of natural fibers, metal fibers, mineral fibers, glass fibers, and/or carbon fibers could be imagined as materials for the production of the strand or cable, synthetic fibers such as aramid or polyethylene fibers are used in the preferred embodiment of the invention.

A thermoplastic is advisably used as the matrix material. In addition to the preferred polypropylene, it is also possible to consider the use of polycarbonate, polyamide, polyethylene, or PEEK.

In the inventive cable, the fibers embedded in the matrix material can form the core of a composite strand, which comprises an external layer of steel wire.

In addition, the embedded fibers can be the core cable of the cable, and the cable can comprise an external layer of strands, preferably of steel wire strands or of the previously mentioned composite strands with a core of fibers and an external layer of steel wire.

The strand or cable is advisably embedded completely in the matrix material. The matrix material then forms a jacket and thus provides protection from the outside. When a strand or a core cable is being produced, furthermore, the strands surrounding the strand or core cable can be embedded in this jacket.

It is obvious that the inventive method can also be used to produce a cable from wires and/or fibers which have already been twisted into strands. In this case, the strands to be cabled are embedded in the matrix material, wherein the matrix material can fill up the voids which may be present in the strands. Strands produced by the method described here can be used to produce the cable.

The method is also advantageous in that it makes it easier to produce cables with a core-jacket structure. Whereas, for the embedding of the core cable, it has been necessary until now to conduct the method in two steps, namely, first, the jacketing of the core cable and then the cabling of the strands onto the core, this can now be carried out in a single step by means of the inventive method.

It is advisable to provide a device for coating the fibers or wires on a cabling machine which can both produce the core cable and twist the strands around the core cable (tandem cabling machine). The core cable is coated with the matrix material at least by the time at which the strands are wound onto the core. In certain cases, the fibers, wires, and/or strands used to produce the core cable will have already been embedded in the matrix material.

Whereas it would be possible to imagine that the fibers, wires, and/or strands could be sprayed with the matrix material, they are, in an especially preferred embodiment of the invention, immersed in the liquefied matrix material before and/or at the cabling point.

In one embodiment of the invention, a heatable container is preferably provided to hold the liquefied matrix material, which container surrounds the fibers and/or wires and/or strands before or at the cabling point.

Alternatively, it is also possible to provide a spray device to spray the liquefied matrix material. It is advisable for the device used to implement the method to be provided with protective walls, at least in the area in which the matrix material is sprayed, to close off the device from the outside and thus to prevent sprayed matrix material from reaching the environment. The space formed by the protective walls can be provided with an exhaust system and an appropriate filter.

It is advisable for the container or the spray device to be connected to an extruder, by means of which the matrix material is liquefied and conveyed toward the spray device or container.

It is advisable for a device for measuring the temperature of the container to be provided to ensure that the container is heated in such a way that the matrix material in the container remains liquid. Adjusting the temperature also makes it possible to change the viscosity of the matrix material and to influence the wetting of the fibers or wires.

In an especially preferred embodiment of the invention, the container comprises a rotatable end wall, which is provided with openings, through which the fibers, wires, and/or strands are guided to the cabling point. The rotatable end wall can be rotated at the same rotational speed as the rotor over which the fibers, wires, and/or strands are guided to the cabling point. The openings are advisably provided with seals, which prevent the matrix material from escaping from the container.

At the end of the container opposite the rotatable wall, another opening is provided, through which the formed strand or the formed cable is to be guided.

It is advisable for the diameter of the additional opening to be the same as the outside diameter of the strand to be formed or of the cable to be formed. As it leaves the container, the strand or the cable is thus brought into the shape intended for it.

Whereas it could be imagined that the rotation of the end wall could be synchronized electromechanically with the rotation of the rotor, in a preferred embodiment of the invention, the rotatable end wall and the rotor are connected to each other The rotor thus carries the end wall along with it as it rotates.

It is advisable for the container to be closed except for the previously mentioned openings. In certain cases, the matrix material can be under increased pressure in the container, so that it wets the fibers more effectively or can penetrate more effectively into any voids which may be present.

After the cable-forming process, especially after the strand or cable has left the container through the previously mentioned opening, it is advisable to cool the strand or the cable, preferably in air or in a cooling fluid such as water, to solidify the matrix material.

In one embodiment of the invention, a calibration ring is arranged in the container, through the opening of which the strand to be formed or the cable to be formed is pulled during the cabling process. The fibers and/or the wires of the strand or of the cable can thus be given the desired shape while still inside the container.

This proves to be especially advantageous when the diameter of the additional opening of the container is larger than the opening of the calibration ring. It is then possible to apply a jacketing of matrix material to the strand or cable during the cabling process itself. This is possible in particular in cases where the viscosity of the matrix material at the previously mentioned additional opening is such that the material retains its form after leaving the opening.

To make this possible, the container is advisably provided with a section of pipe at the end where the formed strand or the formed cable is pulled out, the inside diameter of this section of pipe being larger than the opening of the calibration ring and in which pipe section the matrix material cools and solidifies. For this purpose the pipe section can be provided with a cooling device such as a water cooling device.

In a further embodiment of the invention, the fibers are stretched as they are being cabled and embedded in the matrix material and as the matrix material is cooled until it has solidified, with the result that the fibers are held by the matrix material in the position which they have assumed in the stretched state. It is advisable to stretch the fibers to such an extent that they are brought into a position which they assume when absorbing load, preferably to such an extent that, when load is absorbed by the strand or cable, they undergo plastic stretching precisely according to Hooke's law.

The load absorption can be improved by this measure. The actual absorption of load by strands or cables made of fibers which have not been prestretched begins only after a certain delay, because every time the fibers are subjected to load they must first "settle", that is, arrive at a final spatial arrangement in which they form a stable cross section. This applies in particular to plastic fibers in the form of monofilament bundles. If the fibers have already been stretched while they are being cabled, and as long as they are held in the stretched state until the matrix material has solidified, they are held in the stretched state by the matrix material. The fibers are "frozen" in this stretched condition. This offers the advantage that, in the case of a cable structure consisting of a core cable of fibers and strands of steel, the stretching behavior of the core cable can be adapted to the stretching behavior of the wire strands, and the core cable can thus absorb a significant percentage of a load.

In an elaboration of the invention, it is provided that an additional jacketing is applied after the cabling onto the strand or the cable. If the jacketing, which is preferably formed by a surrounding layer of braid, is put under tension, it can serve to hold the fibers in the above-described pre-tensioned state or it can at least serve to help hold them in this state.

If the jacketing is also embedded in the matrix material, an especially good bond can be created between the fibers and the jacketing. The problem which occurs in the case of known cables, namely, that a jacketed core strand or a jacketed core cable becomes detached from the rest of the cable or from the rest of the strand is therefore eliminated.

An especially strong bond can be achieved when the surrounding braid is formed out of fibers of different thicknesses and/or when it is formed with mesh openings, through which the matrix material penetrates.

The invention is explained in greater detail below on the basis of exemplary embodiments and the attached drawings, which relate to the exemplary embodiments:

DETAILED DESCRIPTION OF THE INVENTION

Figure 1:
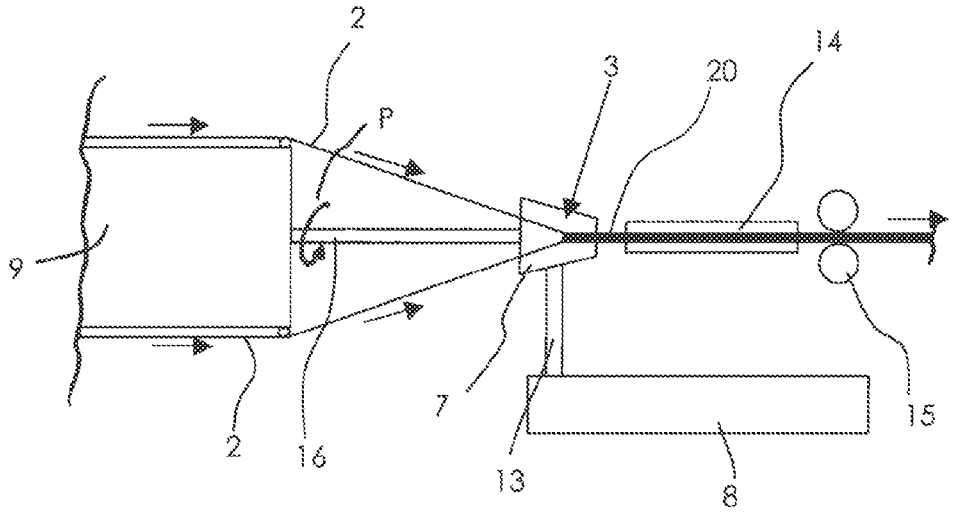
FIG. 1 shows a schematic diagram of an inventive device.

An inventive device shown in FIG. 1 for the production of cables or strands comprises a rotor 9, over which twisted monofilament bundles 2 or aramid fibers are guided to a cabling point 3. On the rotor 9, spools of the type known in themselves (not shown) are arranged, on which the monofilament bundles are wound. During the cable-forming process, the monofilament bundles 2 are unwound continuously from the spools as the rotor 9 turns in the direction of the arrow P. At the cabling point 3, the monofilament bundles 2 are formed into a cable 20 in the manner known in itself. By means of rollers 15, the cable 20 is pulled from the cabling point 3 and wound up on a cable drum.

Figure 2:
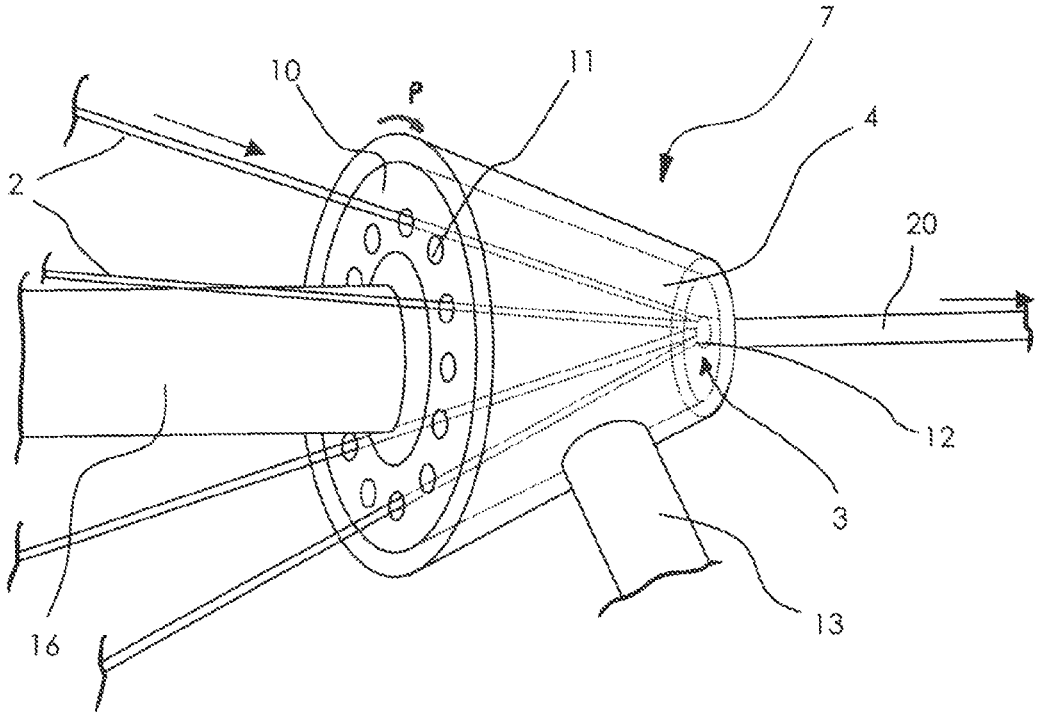
FIG. 2 shows a detail of the inventive device in the form of an isometric diagram.

At the cabling point 3, a container 7, which is shown in more detail in FIG. 2, surrounds the monofilament bundles 2 and the cable 20. The container 7 has a conical shape and is provided at the end facing the rotor 9 with a rotatable end wall 10, which has several openings 11 and which is rigidly connected to the rotor 9 by a connecting web 16. The twisted monofilament bundles 2 are guided from the rotor 9 through the openings 11 to the cable-forming point 3. Only four monofilament bundles 2 are shown in FIG. 2 to serve as an example. Depending on the application, various numbers of openings 11 suitable for the number of monofilament bundles 2 to be formed into a cable can be provided.

The device can form cables not only out of twisted monofilament bundles 2 but also out of previously formed strands. The monofilament bundles 2 can also be formed into cables in combination with previously formed strands.

Another opening 12, through which the cable 20 is guided out of the container 7, is provided at the end of the container 7 opposite the end wall 10. The opening 12 has a diameter which corresponds to the diameter of the cable 20 to be formed. Instead of a circular shape for the opening 12, it is also possible to use some other shape, preferably an asymmetric, angled-oval, or polygonal (e.g., three-sided, four-sided, or five-sided) shape or the shape of a section of a circle (e.g., a semi-circle or quarter-circle).

The container 7 is connected by a heated pipe 13 to an extruder 8, by means of which polypropylene is continuously liquefied and supplied to the container 7. So that the polypropylene 4 remains liquid in the container 7, the container 7 is provided with heating tapes (not shown) in its lateral surface so that it can be heated to a temperature of 200-300° C. A temperature sensor is provided in the container to monitor the temperature.

To produce the inventive cable 20, the monofilament bundles 2 are drawn continuously to the cabling point 3. When the rotor 9 turns, the end wall 10 is turned along as well by the connecting web 16 at the same rotational speed, so that the monofilament bundles 2 are guided continuously through the openings 11 to the cabling point 3. The seals (not shown) provided on the openings 11 prevent polypropylene 4 supplied through the connecting pipe 13 from escaping from the container 7.

In the container 7, the monofilament bundles 2 are coated with the polypropylene 4 before they reach the cabling point 3. The cable-forming process at the cabling point 3 also takes place completely in the polypropylene 4. During the cabling process, the polypropylene 4 is supplied continuously to the container by the extruder 8.

The formed cable is guided out of the container 7 through the opening 12 and into a water bath 14, in which the polypropylene 4 is cooled and solidified. By means of a tensioning device (not shown) to stretch the cable, the cable can be prestretched in such a way that the monofilament bundles 2 assume the position in the cable which they assume under the load which the cable is intended to absorb during use. The monofilament bundles 2 are held by the polypropylene 4 in the stretched state. They are "frozen" in this stretched condition.

Figure 6:
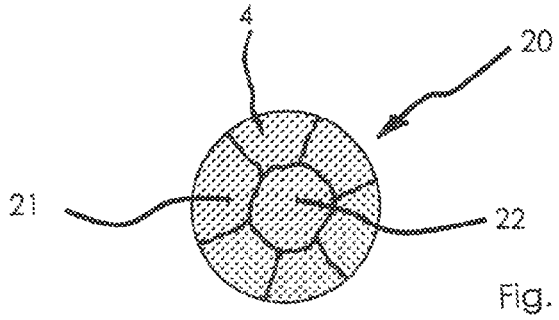
FIG. 6 shows a cross section of an inventive cable.

FIG. 6 shows a cable 20 of aramid fibers produced by means of the method described above. Several fiber strands 21, 22, wound from several twisted monofilament bundles, have been formed into the cable 20. The monofilament bundles, shown as black dots, are surrounded by the polypropylene 4.

Reference is made in the following to FIGS. 3-5 and 7-12, where the same parts or parts of similar function are designated by the same reference numbers as those used in FIGS. 1, 2, and 6, a letter being appended to each of the associated reference numbers.

Figure 3:
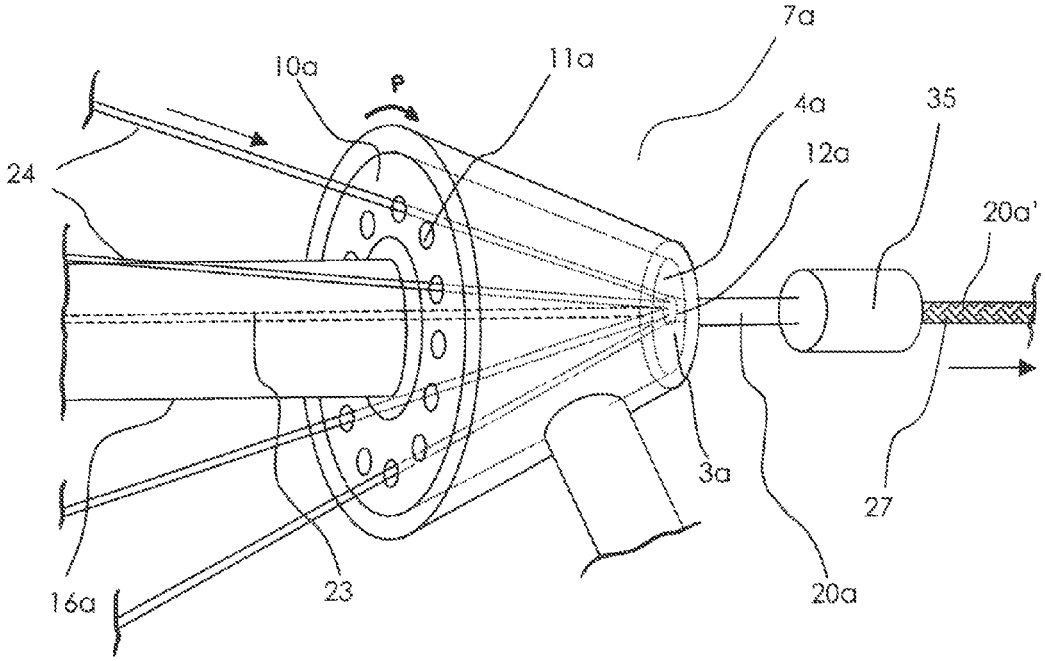
FIG. 3 shows a detail of another inventive device in the form of an isometric diagram.

An inventive device shown in FIG. 3 differs from those according to FIGS. 1 and 2 in that a connecting web 16*a*, which is connected to the rotor, is hollow on the inside, and in that a core cable 23 is guided through the connecting web 16*a* to the cabling point 3*a*. At the cabling point 3*a*, the core cable 23 is formed into a cable 20*a* with the external strands 24 and coated with polypropylene 4*a* as described above.

As an option, the device can also comprise a braiding device 35, indicated only schematically here, by means of which a layer of braid 27 can be applied to the core cable 23 and embedded in the polypropylene 4*a*. The surrounding layer of braid forms a braided cable 20*a*' out of the cable 20*a*.

Figure 4:
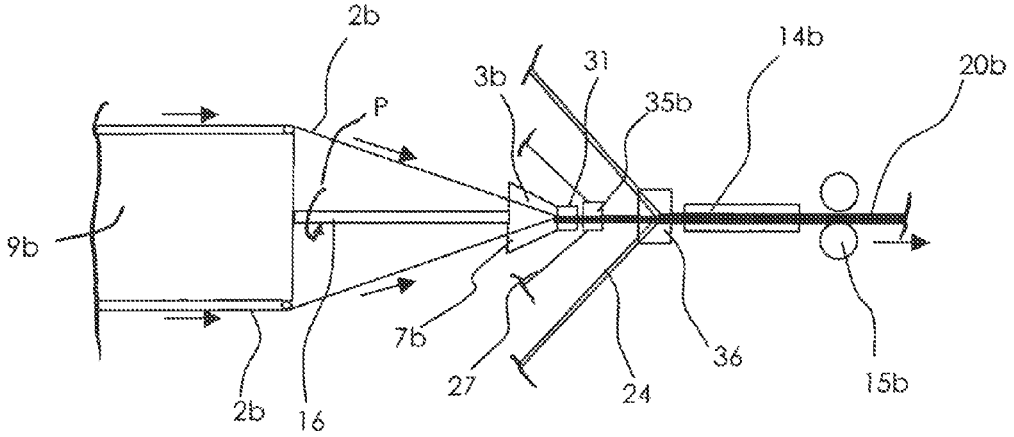
FIG. 4 shows a schematic diagram of another inventive device.
Figure 5:
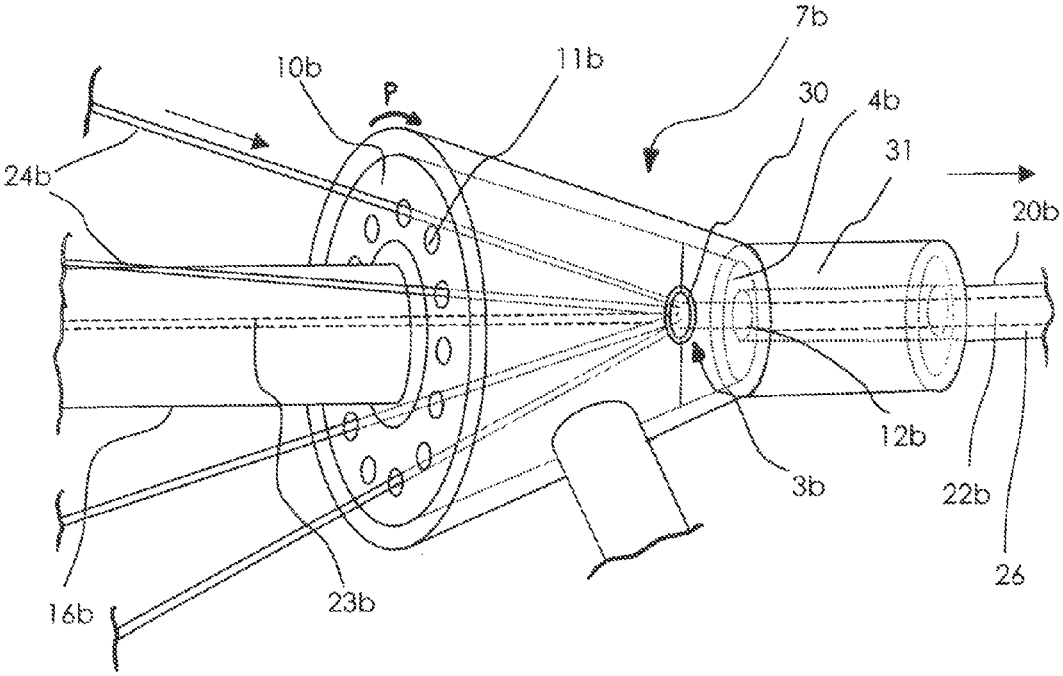
FIG. 5 shows a detail of the inventive device according to FIG. 4 in the form of an isometric diagram.

Another inventive device, shown in FIGS. 4 and 5, comprises, in its container 7*b*, a calibration ring 30, formed by a ring mounted in the container 7*b*, through which a core cable 22*b* to be formed, is pulled to give it its shape after fibers 2*b* have been wound around the core cable 22*b*. At one end of the container 7*b*, namely, the end from which the core cable 22*b* leaves the container 7*b*, a section of pipe 31 is arranged. The inside diameter of the pipe section 31, in the walls of which a water cooling circuit is provided, is larger than the opening of the calibration ring 30. Polypropylene 4*b*, with which the fibers 2*b* are coated, is cooled in the pipe section 31 to a viscosity such that, upon emergence from the pipe section 31, it retains its shape but still remains soft.

The device according to FIG. 5 can be used to provide the core cable 22*b* with a jacketing 26 of polypropylene 4*b* on the fibers.

Figure 7:
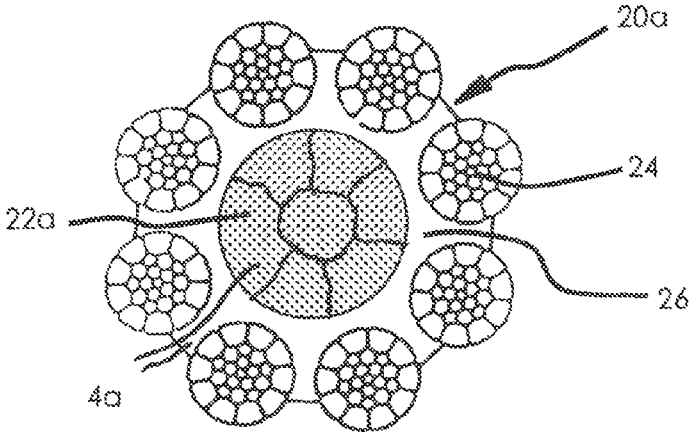
FIG. 7 shows a cross section of another inventive cable.
Figure 8:
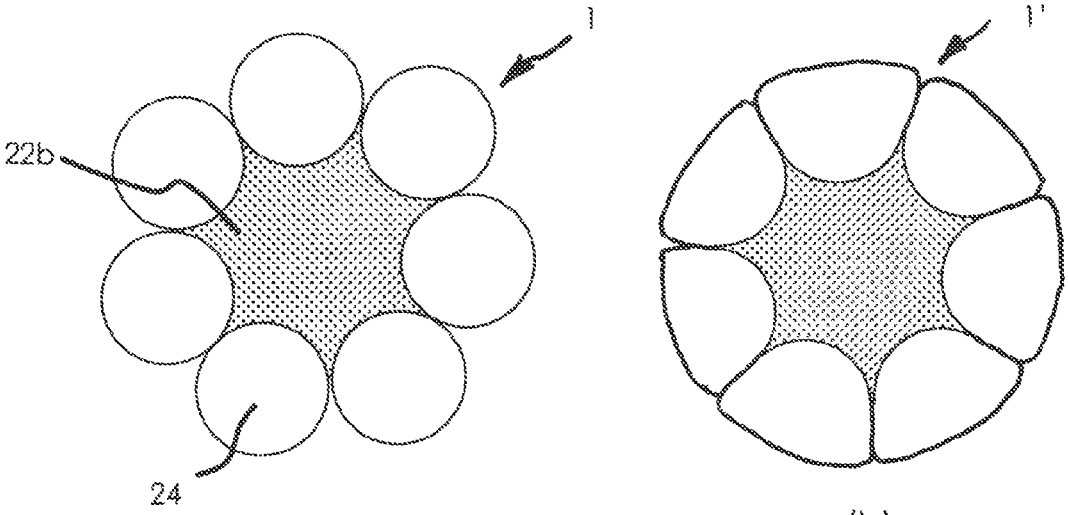
FIG. 8*a* shows a cross-section of an inventive strand.
FIG. 8*b* shows the strand of FIG. 8*a* after compacting.

FIG. 7 shows a composite cable 20*a*, which comprises a core cable 22*a*, which corresponds to the cable 20 described above. The core cable 22*a* is surrounded by a jacketing 26 of the polypropylene 4*a* forming the matrix material. Steel strands 24 have been wound around the core cable 22*a* and thus embedded in the jacket 26. The steel strands were pressed into the matrix material 4*a* of the jacket 26 while the material was still soft.

FIG. 4 shows a schematic diagram of optional enhancements to the part of the device shown in FIG. 5. Downstream in the cable-forming direction from the pipe section 31, a braiding device 26*b* can be provided, by means of which a layer of braid can be applied to the core cable 22*b*.

In addition, another cabling device 36 can be provided, by means of which external strands 24*b* can be wound onto the core cable 22*b*, the strands 24*b* thus becoming embedded in the matrix material 4*b*.

FIG. 8*a* shows a strand 1, the core strand 22*b* of which has been produced by the inventive method and consists of aramid fiber strands embedded in polypropylene. Steel wire 24*b*, shown only schematically here, has been pressed directly into the core cable 22*b* as the core cable 22*b* was being heated during the cable-forming process. FIG. 8*b* shows a strand 1', which is constructed like that according to FIG. 8*a* but which has been compacted by hammering, for example.

Figure 9:
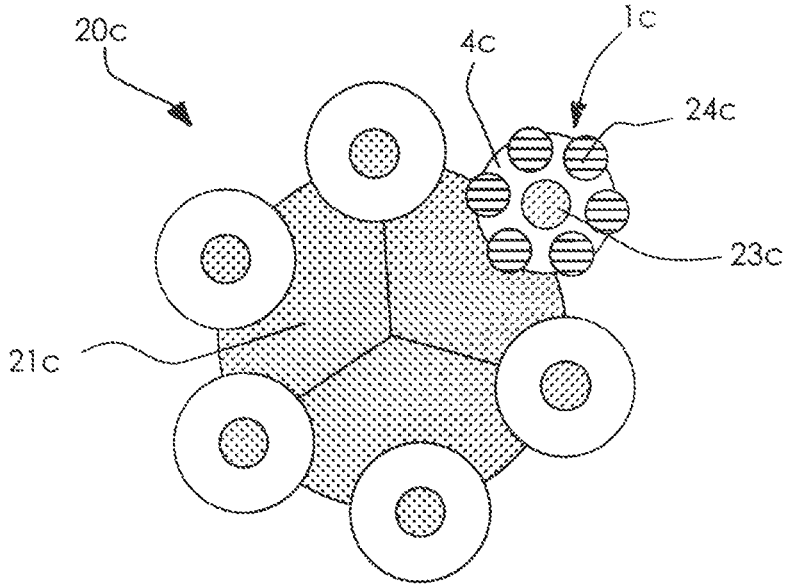
FIG. 9 shows a cross section of another inventive cable.

A composite cable 20*c* shown in FIG. 9 comprises a core cable consisting of three twisted, polypropylene-embedded fiber strands 21*c* of monofilament bundles of aramid fibers, into which, during the cabling process, external strands 1*c* have been pressed. The external strands 1, only one of which is shown in detail, comprise, as a core, polypropylene-embedded aramid fibers 23. In the polypropylene 4*c*, steel wire strands 24*c* are arranged around the aramid fibers 23.

Figure 10:
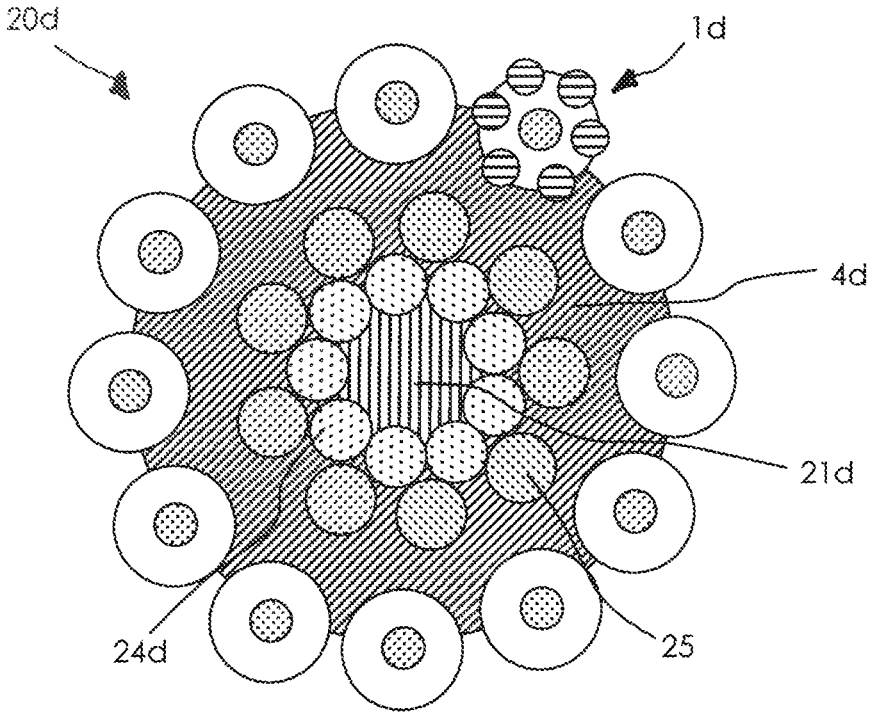
FIG. 10 shows a cross section of another inventive cable.

FIG. 10 shows a composite cable 20*d*, which comprises a core cable embedded in polypropylene 4*d*. The core cable comprises a core 21*d* of polypropylene-embedded monofilament bundles 21*d* of aramid fibers, in which steel wire strands 24*c* are embedded, and around which an additional layer of steel wire strands 25 is wound. External strands 1*d* are seated in the polypropylene 4*d*; these have the same structure as that described above for the strands 24*c* of the exemplary embodiment according to FIG. 9.

Figure 11:
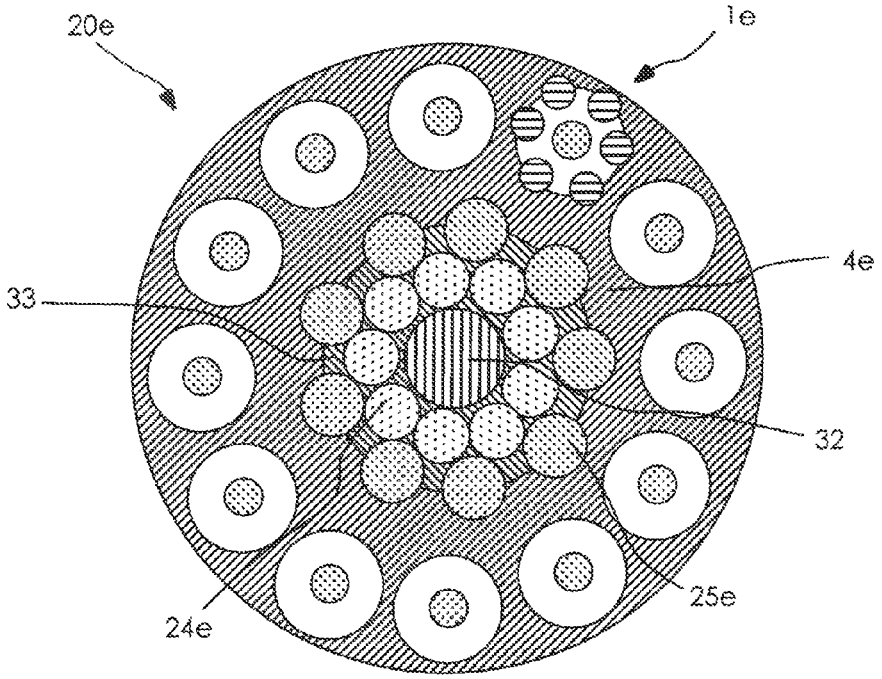
FIG. 11 shows a cross section of another inventive cable.

An inventive composite cable 20*e* shown in FIG. 11 differs from the cables of the previous exemplary embodiments in that the external strands 1*e* are completely embedded in a matrix material of polypropylene 4*e*. A core cable of the cable 20*e* comprises a core strand 32 of steel wire and strands 24*e*, 25*e* wound around it, which comprise here a core (not shown) of aramid fibers embedded in polypropylene. The core strand 32 and the strands 24*e*, 25*e* are surrounded by a lubricant 33. Around the lubricant 33 and the core cable, the method described above is used to cable the external strands 1*e* onto the core cable, and as this is done the core cable with the lubricant 33 is completely embedded together with the external strands 1*e* in the polypropylene 4*e*.

Figure 12:
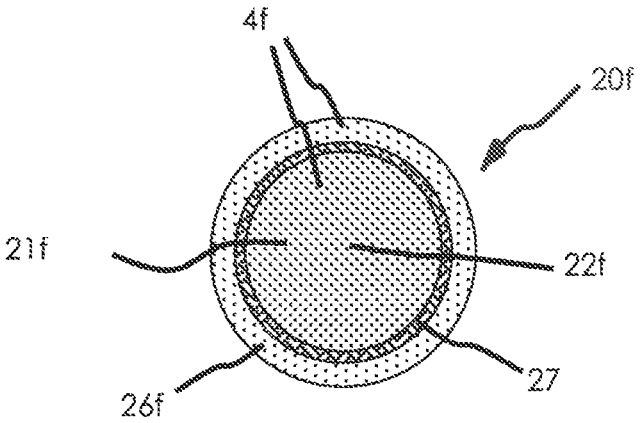
FIG. 12 shows a cross section of another inventive cable.
Figure 13:
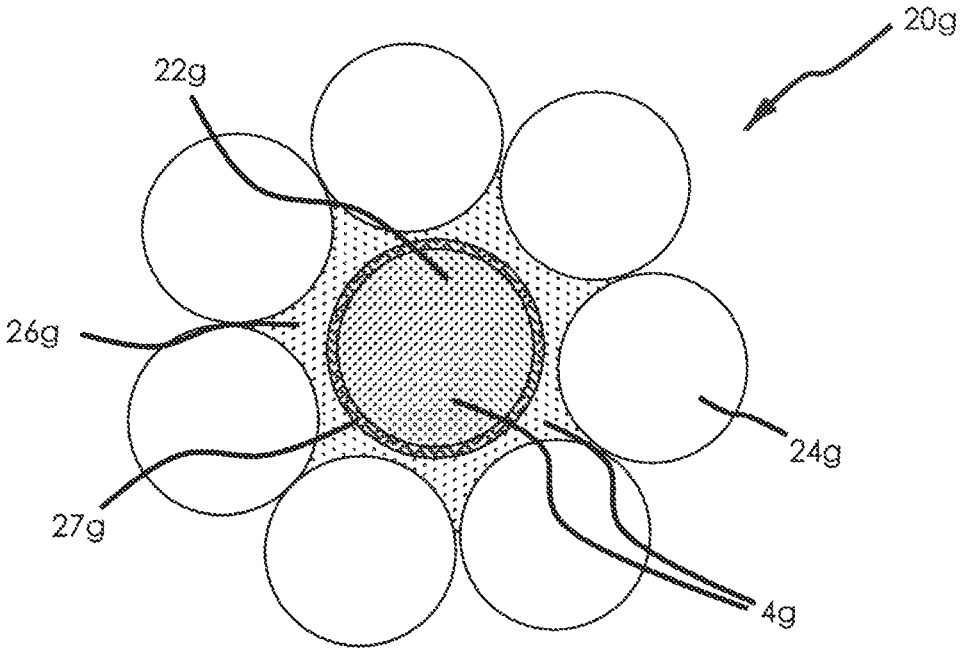
FIG. 13 shows a cross section of another inventive cable.

A cable shown in cross section in FIG. 12 can be produced by using the previously mentioned braiding device 31 to apply a layer of braid 27 into the jacketing 26 around the fibers 22*f* of a core cable. The layer of braid 27 is also embedded in the matrix material 4*f* surrounding the fibers 22*f*, and a good bond is achieved between the fibers on the one side and the braid 27 on the other. A jacket 26 of matrix material 4*f* is formed around the braiding 27. As shown in FIG. 13, external strands 24*g* can be embedded in this jacket 26.

It is obvious that the examples described here can be carried out with matrix materials other than the polypropylene mentioned. For example, polycarbonate, polyamide, polyethylene, or PEEK could be used instead.

In should also be obvious that the individual steps of the method described here can be combined with each other in any way desired depending on the cable structure to be produced. In corresponding fashion, individual components of the production device such as the container, the device for winding the external strands onto the cable, and the braiding device, possibly even several devices of the same type, can also be combined with each other in accordance with the method to be applied.

The invention claimed is:

1. A method for producing a strand, comprising the steps of: coating fibers and/or a monofilament bundle of fibers with a liquefied matrix material, that solidifies after stranding, before and/or at a stranding point; stranding the fibers and/or monofilament bundle of fibers at the stranding point to form a core strand, the fibers and/or the monofilament bundle of fibers embedding in the matrix material during stranding; applying a jacketing made of the matrix material on the core strand; and, after stranding the core strand, a) stranding a layer of steel wire on the jacketed core strand whereby the steel wire is embedded in the matrix material, and/or b) applying an additional jacketing on the jacketed core strand and embedding the additional jacketing on the matrix material.

2. The method according to claim 1, wherein the coating step includes immersing the fibers and/or the monofilament bundle of fibers in the matrix material or spraying the fibers and/or the monofilament bundle of fibers with the matrix material before and/or at the stranding point.

3. The method according to claim 1, further including cooling the strand after the stranding to solidify the matrix material.

4. The method according to claim 3, including stretching the fibers during the stranding, the embedding in the matrix material, and the cooling of the matrix material, until the matrix material has solidified, so that the fibers are held by the matrix material in a position which they assume in the stretched state.

5. The method according to claim 4, including stretching the fibers until the fibers reach a position which they assume when absorbing load.

6. A cable, comprising: a core cable containing monofilament bundles of fibers, wherein the fibers are natural fibers, mineral fibers, glass fibers, carbon fibers and/or synthetic fibers and the monofilament bundles are coated with and embedded in a matrix material so that each of the monofilament bundles is surrounded by the matrix material, wherein the matrix material forms a jacketing on the monofilament bundle of fibers; and a layer of strands cabled onto and embedded in the jacketing.

7. The cable according to claim 6, wherein the fibers consist of high-strength plastic and/or the matrix material comprises a thermoplastic.

8. The cable according to claim 6, wherein the fibers in the core cable are stretched to such an extent that they are in a position which they have when absorbing load.

9. The cable according to claim 6, wherein the fibers in the core cable are stretched to such an extent that, when the cable is absorbing a load, the fibers directly undergo plastic stretching according to Hooke's law.

10. The cable according to claim 6, further comprising a jacketing, which surrounds the core cable and holds the core cable together under tension.

11. The cable according to claim 10, wherein the jacketing is formed by a layer of braid.

12. The cable according to claim 11, wherein the braid comprises mesh openings that are permeated by the matrix material.

13. An apparatus for producing a strand or a cable, comprising: a device for supplying fibers and/or wires to a cabling point and for forming the fibers and/or the wires into a cable at the cabling point; a device for coating the fibers and/or the wires before and/or at the cabling point with a liquefied matrix material into which the fibers and/or the wires are embedded; and a device for applying a jacketing to the strand or cable, wherein the jacketing device is a braiding machine.

14. A method for producing a cable, comprising the steps of coating fibers and/or a monofilament bundle of fibers with a liquefied matrix material, that solidifies after cabling, before and/or at a cabling point; cabling the fibers and/or monofilament bundle of fibers at the cabling point to form a core cable, the fibers and/or the monofilament bundle of fibers embedding in the matrix material during cabling; applying a jacketing made of the matrix material on the core cable; and, after cabling the core strand, a) applying a layer of strands on the jacketed core cable whereby the strands are embedded in the matrix material, and/or b) applying an additional jacketing on the jacketed core cable and embedding the additional jacketing on the matrix material.

15. The method according to claim 14, further including applying a jacketing to the cable after the cabling step.

16. The method according to claim 14, wherein the coating step includes immersing the fibers and/or the monofilament bundle of fibers in the matrix material or spraying the fibers and/or the monofilament bundle of fibers with the matrix material before and/or at the cabling point.

17. The method according to claim 14, further including cooling the cable after the cabling to solidify the matrix material.

18. The method according to claim 17, including stretching the fibers during the cabling, the embedding in the matrix material, and the cooling of the matrix material, until the matrix material has solidified, so that the fibers are held by the matrix material in a position which they assume in the stretched state.

19. The method according to claim 18, including stretching the fibers until the fibers reach a position which they assume when absorbing load.

20. A strand, comprising: a core strand containing monofilament bundles of fibers, wherein the fibers are natural fibers, mineral fibers, glass fibers, carbon fibers and/or synthetic fibers and the monofilament bundles are coated with and embedded in a matrix material so that each of the monofilament bundles is surrounded by the matrix material, wherein the matrix material forms a jacketing on the monofilament bundle of fibers; and a layer of steel wires stranded onto and embedded in the jacketing.

21. A cable, comprising: a core cable containing fibers and/or monofilament bundles of fibers, wherein the fibers and/or the monofilament bundles are coated with and embedded in a matrix material and the matrix material forms a jacketing on the fibers and/or the monofilament bundle of fibers; a) a layer of strands cabled onto and embedded in the jacketing, and/or b) an additional jacketing provided on and embedded in the jacketing; and a jacketing, which is formed by a layer of braid and surrounds the core cable and holds the core cable together under tension.

22. The cable according to claim 21, wherein the braid comprises mesh openings that are permeated by the matrix material.

* * * * *